US005803584A

United States Patent [19]

Chung

[11] Patent Number: 5,803,584

[45] Date of Patent: Sep. 8, 1998

[54] STRUCTURE OF HAND TOOL

[76] Inventor: Chih-Wen Chung, P.O. Box 82-144, Taipei, Taiwan

[21] Appl. No.: 834,139

[22] Filed: Apr. 14, 1997

[51] Int. Cl.[6] ..... B25B 23/18

[52] U.S. Cl. ..... 362/120; 362/119; 81/440

[58] Field of Search ..... 362/109, 119, 362/120; 81/436, 439, 440, 177.4, 490; 7/165

[56] References Cited

U.S. PATENT DOCUMENTS 4,440,048 4/1984 Stevens et al. ..... 81/436

4,476,751 10/1984 Mishima ..... 81/440

*Primary Examiner*—Y. My Quach

*Attorney, Agent, or Firm*—A & J

[57] ABSTRACT

A hand tool includes a cylindrical casing which has a tapered front end, an annular groove around the tapered front end, and a plurality of tool bit grooves longitudinally extended from the tip of the tapered front end across the annular groove to the rear end of the casing, and a tool bit unit which includes a binding ring mounted in the annular groove of the casing, and a set of bits respectively pivoted to the binding ring and turned between a first position received in the tool bit grooves of the casing, and a second position retained in alignment with the casing longitudinally.

3 Claims, 4 Drawing Sheets

STRUCTURE OF HAND TOOL

BACKGROUND OF THE INVENTION

1. Field of the Invention

This invention relates to hand tools, and more particularly to such a hand tool which comprises a set of bits pivoted to a cylindrical casing, and turned between the operative position retained in longitudinal alignment with the casing, and the non-operative position received in tool bit grooves outside the casing.

2. Description of the Prior Art

When repairing furniture or electric home appliances, or assembling do-it-yourself furniture, a variety of hand tools may be used. There are known various tool sets comprised of a handle and a set of tool bits adapted for attaching to the handle. These tool sets must be carefully received in a tool box or the like when not in use. Because the tool bits of a tool set are separately received, they tend to be lost in work place.

Therefore, it is an object of the present invention to provide an improved hand tool which can obviate and mitigate the above-mentioned drawbacks.

SUMMARY OF THE INVENTION

This invention relates to a hand tool which comprises a set of bits pivoted to a cylindrical casing, and turned between the operative position retained in longitudinal alignment with the casing, and the non-operative position received in tool bit grooves outside the casing.

It is one object of the present invention to provide a hand tool which keeps a set of tool bits to be retained together. It is another object of the present invention to provide a hand tool which comprises a set of tool bits that can be alternatively turned between the operative position and the non-operative position. It is still another object of the present invention to provide a hand tool which can be simultaneously used as a flash light. According to one aspect of the present invention, the hand tool comprises a cylindrical casing which has a tapered front end, an annular groove around the tapered front end, and a plurality of tool bit grooves longitudinally extended from the tip of the tapered front end across the annular groove to the rear end of the casing, and a tool bit unit which includes a binding ring mounted in the annular groove of the casing, and a set of bits respectively pivoted to the binding ring and turned between a first position received in the tool bit grooves of the casing, and a second position retained in alignment with the casing longitudinally. According to another aspect of the present invention, a bulb and a set of battery cells are mounted inside the casing, and controlled to give light by a rotary cap at the rear end of the casing.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

BRIEF DESCRIPTION OF THE DRAWINGS

The invention is further described hereafter, by way of example only, with reference to the accompanying drawings, in which.

DETAILED DESCRIPTION OF THE PREFERRED EMBODIMENT

Figure 1:
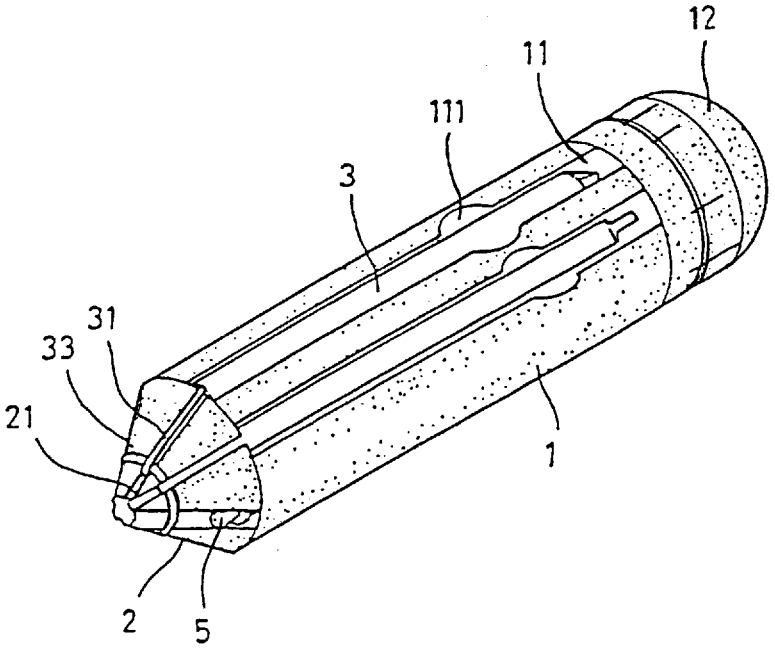
FIG. 1 is an elevational view of a hand tool according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
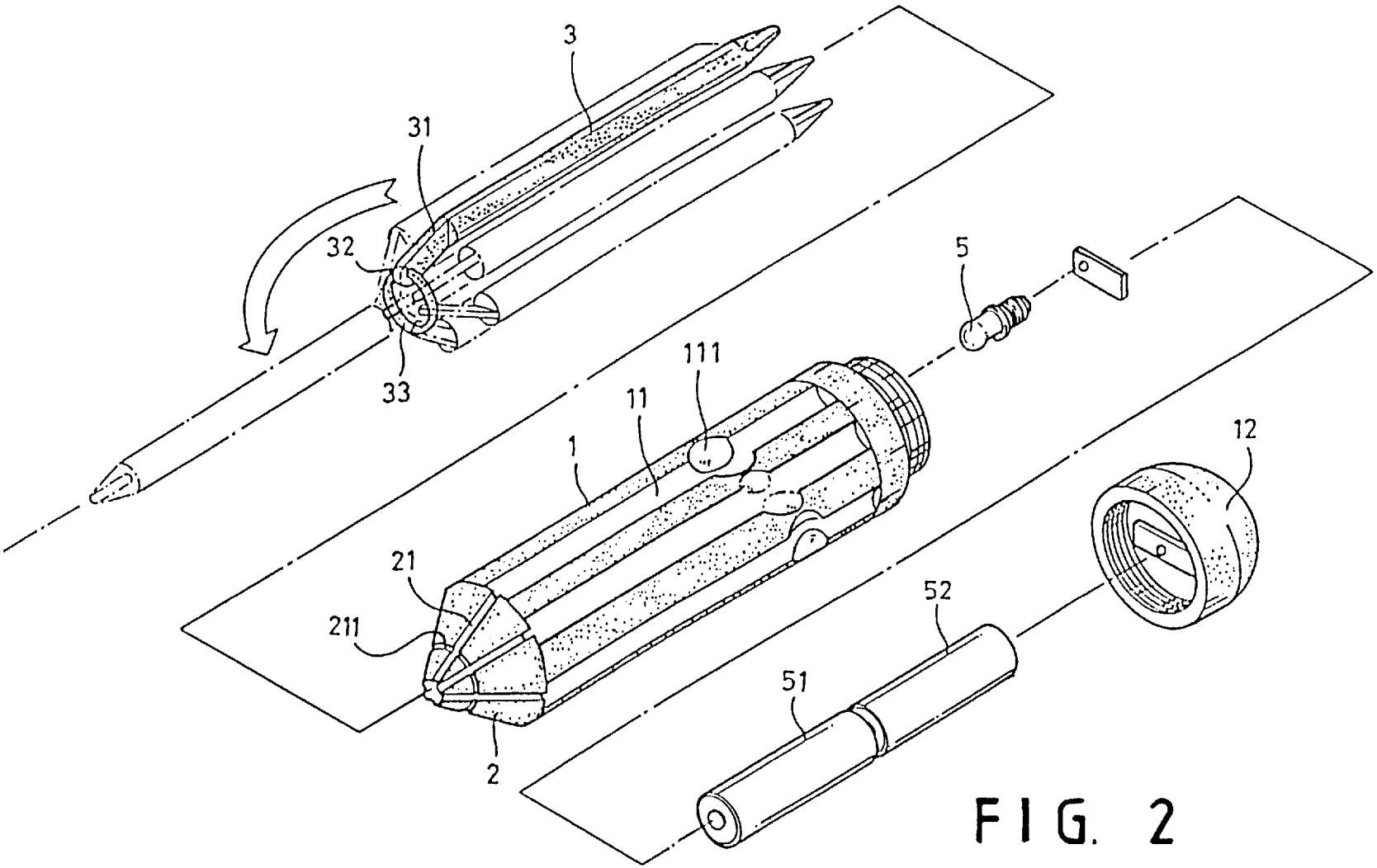
FIG. 2 is an exploded view of the hand tool shown in FIG. 1.

Referring to FIGS. 1 and 2, the hand tool in accordance with the present invention comprises a hollow, cylindrical casing 1. The casing 1 has a plurality of longitudinal grooves 11 equiangularly spaced around the periphery, and a tapered front end 2. The tapered front end 21 of the casing 1 has a plurality of radial grooves 21 respectively extended from the longitudinal grooves 11 and met at the end of the tapered front end 21, and an annular groove 211 disposed around the periphery and intersecting the radial grooves 21. A tool bit unit 3 is provided comprised of a set of bits 3 having a respective flat oblique head 31 and a respective mounting hole 32 at the head 31, and a mounting ring 33 mounted in the mounting holes 32 of the heads 31 of the bits 3 to join the bits 3 together. The mounting ring 33 is adapted to be secured to the annular groove 211 of the tapered front end 2 of the casing 1, permitting the bits 3 to be respectively received in the longitudinal grooves 11 of the casing 2 and the heads 31 of the bits 3 in the radial grooves 21. Smoothly curved recessed portions 111 are respectively formed at the longitudinal grooves 11 of the casing 1. Through the smoothly curved recessed portions 111, the fingers can be conveniently inserted into the longitudinal grooves 11 to pick up the bits 3 respectively. A bulb 5 is mounted inside the casing 1 near its front end, a set of battery cells 51 and 52 are mounted inside the casing 1. A rotary cap 12 is threaded onto the threaded rear end (remote from the tapered front end 2) of the casing 1 to hold down the battery cells 51 and 52, and turned to control the electric passage between the battery cells 51 and 52 and the bulb 5.

Figure 3:
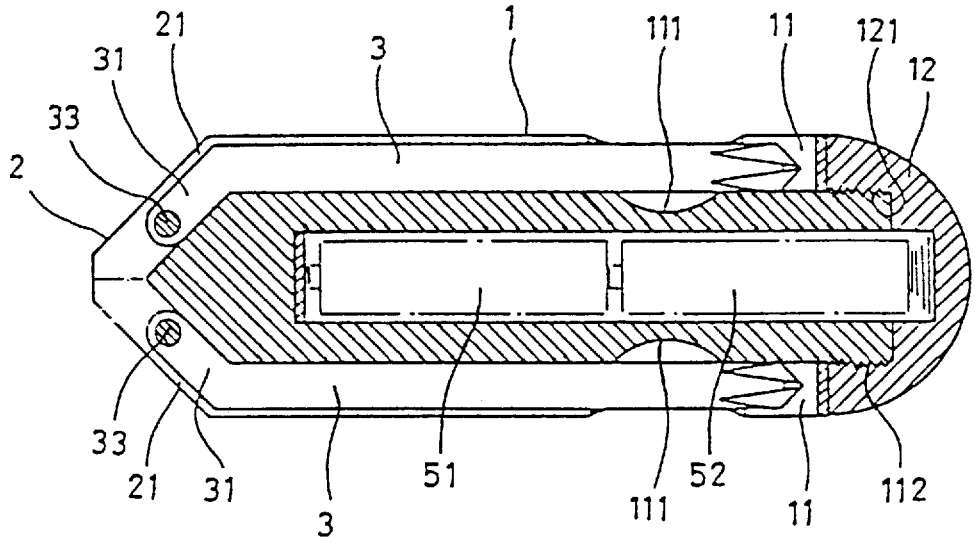
FIG. 3 is a longitudinal view in section of the hand tool shown in FIG. 1.
Figure 4:
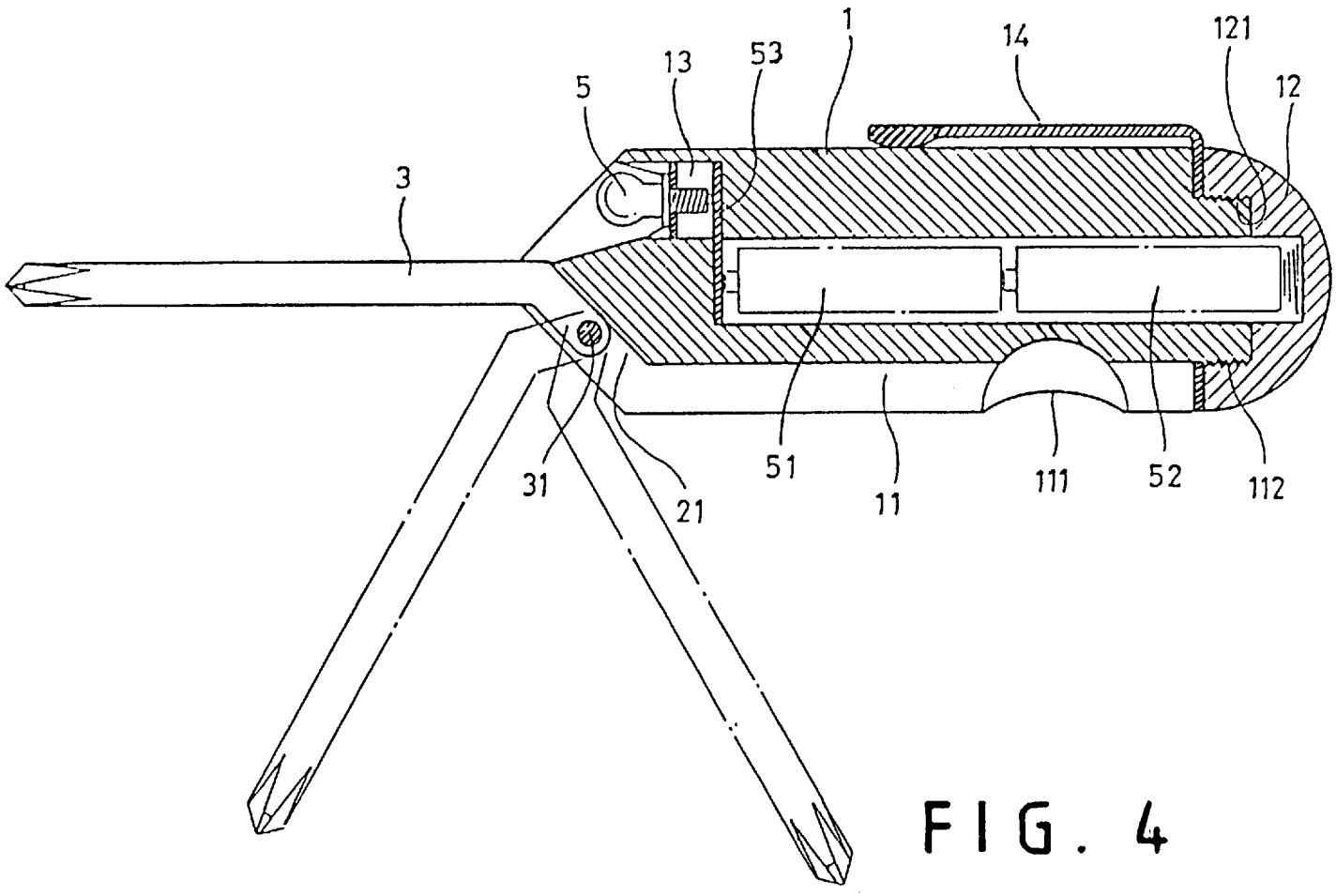
FIG. 4 is a sectional view of the present invention, showing the bits turned out of the longitudinal grooves of the casing.

Referring to FIGS. 3 and 4, the casing 1 defines a storage chamber 13 which receives the bulb 5 and the battery cells 51 and 52, and an outer thread 112 at its rear end onto which the inner thread 121 of the rotary cap 12 is threaded. When the rotary cap 12 is threaded inwards, the battery cells 51 and 52, the bulb 5 and a metal contact plate 53 form a close circuit, and therefore the bulb 5 is turned on. When in use, the bits 3 can be alternatively turned out of the longitudinal grooves 11 of the casing 1 and retained at the operative position in longitudinal alignment with the longitudinal central axis of the casing 1 as shown in FIG. 4. Further, a clip 14 is fastened to the casing 1 and secured in place by the rotary cap 12. By means of the clip 14, the hand tool can be fastened to the user's pocket, belt, etc.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A hand tool comprising:

a cylindrical casing having a plurality of longitudinal grooves equiangularly spaced around and along a periphery of the casing, and a tapered front end, a plurality of radial grooves on said front and respectively extended from said longitudinal grooves and met at a point, and an annular groove disposed around a periphery of said tapered front end and intersecting said radial grooves; and a tool bit unit mounted on said casing, said tool bit unit comprising a binding ring mounted in the annular groove of the tapered front end of said casing, and a set of bits respectively pivoted to said binding ring and turned between a first position received in the radial grooves and longitudinal grooves of said casing, and a second position retained in alignment with said casing longitudinally, each of said bits having bit body configured to be received in one longitudinal groove of said casing, and a flat oblique head pivoted to said binding ring and adapted to be received in one radial groove of the tapered front end of said casing.

2. The hand tool as claimed in claim 1, wherein said casing comprises a plurality of smoothly curved recessed portions respectively disposed at the longitudinal grooves through which the fingers can be inserted into the longitudinal grooves of said casing to pick up said bits.

3. The hand tool an claimed in claim 1, further comprising a lighting circuit assembly mounted inside said casing and controlled to give light by a rotary cap threaded onto a threaded roar end of said casing, said lighting circuit assembly comprising a bulb mounted inside said casing near the tapered front end, a set of battery calls mounted inside said casing and held down by said rotary cap, and a metal contact plate disposed between said set of battery cells and said bulb, said metal contact plate being forced by said battery cells into contact with said bulb when said rotary cap is threaded inwards into said casing, causing said bulb to be turned on.

* * * * *